US006399073B2

(12) United States Patent
Pinkney

(10) Patent No.: US 6,399,073 B2
(45) Date of Patent: Jun. 4, 2002

(54) CAPSICUM LACHRYMATOR

(75) Inventor: Barry D. Pinkney, Jefferson, OH (US)

(73) Assignee: Defense Technology Corporation of America, Casper, WY (US)

( * ) Notice: Subject to any disclaimer, the term of this patent is extended or adjusted under 35 U.S.C. 154(b) by 0 days.

(21) Appl. No.: 09/826,622

(22) Filed: Apr. 5, 2001

Related U.S. Application Data

(60) Continuation of application No. 08/288,974, filed on Aug. 10, 1994, which is a division of application No. 07/831,593, filed on Feb. 5, 1992, now Pat. No. 5,217,708.

(51) Int. Cl.[7] ..... A01N 65/00; A01N 37/18

(52) U.S. Cl. ..... 424/195.1; 424/45; 514/627; 514/918; 514/920

(58) Field of Search ..... 424/195.1, 45; 514/627, 918, 920

(56) References Cited

U.S. PATENT DOCUMENTS

| | | | | |
|---|---|---|---|---|
| 2,146,715 A | | 2/1939 | Barker et al. | |
| 2,171,701 A | | 9/1939 | Howett | |
| 3,192,105 A | | 6/1965 | Wortley et al. | |
| 3,671,637 A | | 6/1972 | Knowles | |
| 3,676,562 A | * | 7/1972 | Knowles | 424/320 |
| 3,678,171 A | * | 7/1972 | Knowles | 424/300 |
| 3,764,682 A | | 10/1973 | Knowles | |
| 4,160,035 A | | 7/1979 | Levai et al. | |
| 4,486,450 A | | 12/1984 | Bernstein | |
| 4,536,404 A | | 8/1985 | Bernstein | |
| 4,546,112 A | * | 10/1985 | LaHann et al. | 514/627 |
| 4,663,315 A | | 5/1987 | Hasegawa et al. | |
| 4,735,803 A | | 4/1988 | Katz et al. | |
| 4,739,990 A | | 4/1988 | Aguire et al. | |
| 4,853,413 A | | 8/1989 | Katz et al. | |
| 5,084,097 A | | 1/1992 | McCreary et al. | |
| 5,178,879 A | | 1/1993 | Adekunle et al. | |
| 5,217,708 A | | 6/1993 | Pinkney | |
| 5,364,626 A | | 11/1994 | Hasegawa et al. | |
| 5,368,866 A | | 11/1994 | Loucas | |

FOREIGN PATENT DOCUMENTS

JP 49-023440 6/1974

OTHER PUBLICATIONS

Derwent Abstract 82–61932e/30 (corresp. To FR 2 495 469 A).
*Hack's Chemical Dictionary*, 4th Ed., p. 130.
Patent Abstracts of Japan C 289, vol. 9, No. 160, 51C 289 (corresponding to JP 60–034, 153).
The Merck Index (Eleventh Ed.) pp. 266–267 (1989).
Law, *J. Assoc. Off. Anal. Chem.*, vol. 66 (5) pp. 1304–1306 (1983).
Fung, et al., *J. Forensic Sci*, vol. 27 (4) pp. 812–821 (1982).

* cited by examiner

*Primary Examiner*—Ralph Gitomer
*Assistant Examiner*—Devesh Khare
(74) *Attorney, Agent, or Firm*—Renner, Otto, Boisselle & Sklar LLP

(57) ABSTRACT

The present invention provides a capsicum containing lachrymator. The lachrymator comprises a nonflammable carrier and capsicum. The nonflammable carrier comprises propylene glycol, ethyl alcohol and water. In one preferred embodiment the lachrymator comprises about 0.3 percent by weight capsicum, about 14.7 percent by weight propylene glycol, about 35 percent by weight ethyl alcohol and about 50 percent by weight water.

20 Claims, 1 Drawing Sheet

CAPSICUM LACHRYMATOR

RELATED APPLICATIONS

Figure 1:
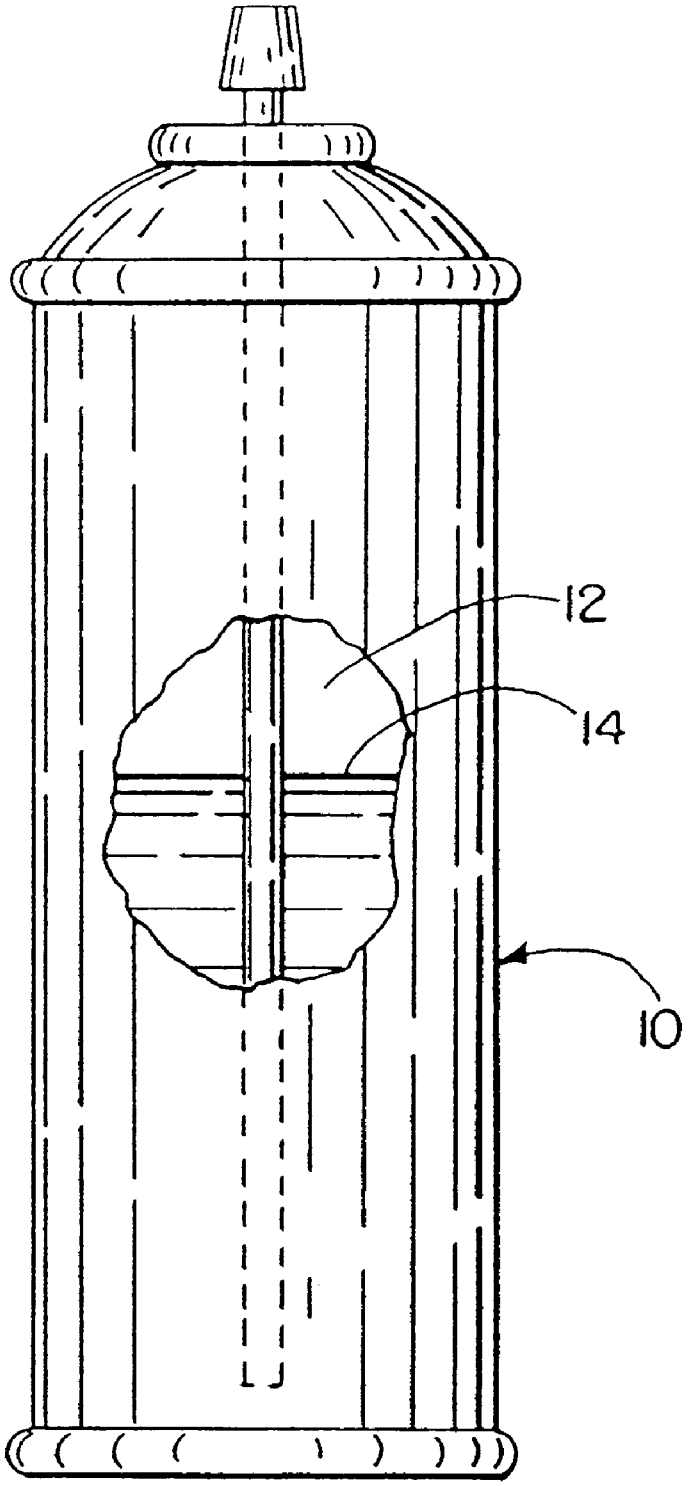

This application is a continuation of application Ser. No. 08/288,974, filed Aug. 10, 1994, which is a division of application Ser. No. 07/831,593, filed Feb. 5, 1992, now U.S. Pat. No. 5,217,708.

TECHNICAL BACKGROUND

The present invention concerns a liquid composition for use as a lachrymator. More particularly, the invention concerns a lachrymator produced utilizing capsicum and a nonflammable water based carrier.

BACKGROUND

The prior art provides various compositions which constitute strong irritants to the eyes, mouth and nose of a human and other animals. Such compositions are generally classified as lachrymators. Lachrymators are better known, and commonly referred to as "tear gas" or "riot gas". Lachrymators serve a significant role in society because they allow the police, military and other authorities to control unruly or disruptive persons, including persons under the influence of alcohol or other mind-altering drugs, without having to resort to physical means that may inflict long-term or permanent bodily harm or damage.

Upon application of a lachrymator, the recipient of the lachrymator is overcome by eye, nose and mouth irritation and rendered harmless. More particularly, upon application the recipient is temporarily disabled with intense burning eye pain, blepharospasm, acute bronchitis and respiratory irritation. The prior art provides various means for dispensing or applying lachrymators, such as, for example, pressurized canisters, hand grenades, and munition cartridges.

The need for an aerosol irritant-type spray or lachrymator, for enforcement and defensive purposes, is historic as well as present day evident. Social unrest, demonstrations and rioting during the 1960's caused the extensive use of military type tear gas agents, known typically as the chemicals CN (chloroaceto-phenone) and CS (ortho-chlorobenzalmalononitrile). These tear gases are actually irritants causing pain and discomfort to the lacrimal glands (tear ducts) and the upper respiratory system. Delivery systems for these agents were comprised mainly of grenades and projectiles, commonly designed as pyrotechnic (burning) type devices. In Wortley, Jr. et al. U.S. Pat. No. 3,192,105 there is disclosed a method of combining CN with a colloidal silica to produce a solid phase form of lachrymator. As disclosed in the '105 patent, this solid phase lachrymator is well suited for use in munitions which disperse the lachrymator by an explosion or similar means.

The search began for more modern methods of delivery/dispersion of tear gas agents, with limited fire potential and more limited (controllable) area coverage. In 1966, Smith and Wesson, through acquisition of General Ordnance Equipment Company, introduced CHEMICAL MACE®. lachrymator, a liquid based CN chemical formula which was filled into pressurized aerosol spray containers.

CHEMICAL MACE® lachrymator has been the forerunner of all such products since its introduction in 1966. Its use greatly lessens the amount of physical force which might be necessarily applied by a law enforcement officer, corrections officer or security officer when attempting to detain a suspect or disperse a crowd of unruly persons. This type of product fits into the low-end of a "use of force" scale which generally begins with talking on the low side, and escalates to shooting on the high side. Thus, lachrymators are generally classified as "nonlethal weapons".

The original CHEMICAL MACE® lachrymator formula consisted of trichlorotrifluoroethanes (CFC's 111, 113) and cosmetic kerosene as the carrier agent/solvent, blended with the active ingredient (CN), and pressurized with carbon dioxide as the propellant. This formula has successfully undergone the most extensive scientific and medical test and studies of any similar use type formulation in history. As a result, this formula was used extensively until about 1990. Specifically, beginning about 1990 there was increasing pressure on the chemical industry to phase out ozone depleting substances (i.e., chlorofluorocarbons—CFC's) under the provisions of the Clean Air Act.

The CFC's, which serve as a nonflammable carrier, provide a significant advantage for the lachrymator solution. Specifically, lachrymator solutions that employ a CFC carrier are generally less likely to ignite. More particularly, when a lachrymator is dispensed, there is always the possibility that an open flame or other source of ignition may be present that could ignite the carrier of the mixture resulting in serious bodily harm to both the user and the intended recipient of the lachrymator. Examples of some possible sources of ignition include lit cigarettes or cigars, burning candles or matches, and stoves or other heating devices employed by persons involved in illicit drug use and/or processing. A nonflammable carrier is less likely to ignite when exposed to such sources of ignition and is thus a preferred carrier for use in lachrymators.

Governmental actions in the United States, already taken as a result of the regulatory impact on CFC's, have extended to international proportions resulting for example in the complete banning of CFC's in such countries as Canada. It is likely that CFC's will be totally phased out before the year 2000, and users in the United States are already paying a federal controlled substance use tax.

Manufacturers of CFC substances have been relentless in their search for acceptable substitutes. However, to this date, manufacturers have only been able to provide solvent replacements that do not totally eliminate the problem. The most recent substitute offered is a halogenated fluorocarbon, HCFC-141b. This solvent appeared to be the solution as it complied with the mandate to reduce ozone depleting potential. However, the first danger signal was sounded on Oct. 15, 1991 in a notice which stated that the U.S. Environmental Protection Agency (EPA) did not believe that HCFC-141b was a necessary solvent replacement, and they were taking the position that they had the authority, under the Clean Air Act, to make it unlawful to use HCFC-141b as a solvent replacement. Accordingly, there is currently a need to develop a new carrier system for lachrymators which does not employ CFC's.

Capsicum (also known as cayenne pepper) and its chemical equivalents such as capsaicin ($C_{18}H_{27}NO_2$) have also been utilized to produce lachrymators for many years. Such lachrymators are commonly utilized in the liquid phase and are dispensed from pressurized canisters or bottles. Generally, prior art capsicum containing lachrymators comprise a mixture of capsicum, soybean oil and an alcohol type solvent. Capsicum containing lachrymators are preferred by some users. More particularly, some users believe that capsicum containing lachrymators are more effective than other prior art lachrymators. Some users also believe that capsicum containing lachrymators are particularly effective for use on large animals such as bears. Additionally, some users prefer capsicum because it is a "natural" material as compared to the man-made chemicals CS and CN.

From a physiological standpoint it was noted that CN and CS did not consistently affect persons who were under the influence of alcohol or drugs. Also, from a psychological viewpoint CN and CS did not always affect those persons who were extremely outraged, emotionally disturbed or suffering from neurotic psychological symptoms.

On the other hand, some studies conducted with capsicum have concluded that, if properly dispensed, the capsicum would effect a person in all circumstances including those who were acting under the physiological and psychological influences noted above.

Unfortunately, because the prior art capsicum containing lachrymators also contain carriers which are primarily alcohol, they are considered unacceptable by some users. More particularly, some persons believe the prior art lachrymators may present too much of a fire hazard. Additionally, some persons consider the prior art capsicum containing lachrymators to be unacceptable because they believe the carrier which is primarily alcohol may have an adverse impact upon tests which are utilized to determine the blood-alcohol level of a person exposed to the lachrymator. Thus, there is a need for a carrier system which does not adversely impact upon the blood-alcohol level of a recipient, is suitable for use with capsicum, does not contain CFC's and is nonflammable.

SUMMARY OF INVENTION

The present invention provides a new and useful capsicum containing liquid lachrymator solution which provides various distinct advantages over prior art capsicum containing lachrymators. More particularly, the lachrymator of the present invention includes a nonflammable carrier that is generally acceptable for use around or in the vicinity of potential sources of ignition such as, for example, lit cigarettes or cigars, candles and stoves. Furthermore, the nonflammable carrier does not contain any CFC's. Also, the lachrymator tends not to adversely impact upon the blood-alcohol level of a recipient. Additionally, the lachrymator is suitable for use in conventional pressurized aerosol spray canisters or containers and thus it does not have to be thermally vaporized by a heat source in order to perform properly. Further, the lachrymator is substantially water based yet it is very stable for it does not freeze through a normal range of temperatures and it does not separate over periods of time. The lachrymator is also stable in that it does not spoil or lose its effectiveness over periods of time and there are no adverse interactions or reactions observed as between the various components of the lachrymator. Further, the lachrymator can be disposed of in a conventional manner.

A lachrymator solution made in accordance with the principles of the present invention comprises capsicum and a nonflammable carrier. The nonflammable carrier comprises water, ethyl alcohol and glycol. Preferably, the glycol comprises propylene glycol. As used herein this specification and the claims below the term "capsicum" includes capsicum chemical equivalents such as capsaicin. Also, as used herein this specification and the claims below the term "lachrymator" is intended to be afforded a broad interpretation including any irritant-type product that may be utilized for defense purposes.

In a preferred best mode embodiment the lachrymator solution comprises about 0.3 percent by weight capsicum, about 14.7 percent by weight propylene glycol, about 35 percent by weight ethyl alcohol and about 50 percent by weight water.

The foregoing and other features of the invention are hereinafter more fully described and particularly pointed out in the claims, the following description setting forth in detail certain illustrative embodiments of the invention, these being indicative, however, of but a few of the various ways in which the principles of the invention may be employed.

DRAWINGS

In the appended drawings:

FIG. 1 is a broken away illustration of a conventional aerosol canister for use with the lachrymator solution of the present invention.

DETAILED DESCRIPTION

The lachrymator of the present invention is produced utilizing a mixture of a nonflammable carrier and capsicum. As used herein this specification and in the claims below the term "nonflammable" means having a flash point in excess of about 100° F. or an ignition point above 500° F.

In addition to being nonflammable, the carrier of the present invention should be suitable for use in a lachrymator. Specifically, the carrier is preferably substantially nontoxic (i.e., substantially free of chemicals classified as being toxic in the *Aldrich Catalog Handbook of Fine Chemicals* 1990–1991 which is distributed by Aldrich Chemical Company, Inc.). As used in this specification and the claims below the language "suitable for use in a lachrymator" means substantially free of chemicals classified in the *Aldrich Catalog Handbook of Fine Chemicals* 1990–1991 as being toxic. Preferably, the lachrymator and its carrier are nontoxic and thus contain no chemicals classified in the *Aldrich Catalog Handbook of Fine Chemicals* 1990–1991 as toxic.

Capsicum is commercially available in a form which is primarily geared for use by the food industry. More particularly, the capsicum is available in combination with soybean oil and in combination with propylene glycol.

The availability of capsicum in combination with soybean oil presented a problem. More particularly, applicants found that the soybean oil did not stay in solution to a sufficient extent when used in conjunction with certain carriers. However, applicants have found that the capsicum in combination with propylene glycol could be used in conjunction with other materials so as to provide a suitable nonflammable capsicum containing lachrymator.

Fortunately, the lachrymator made in accordance with the principles of the present invention may be utilized in any number of conventional pressurized aerosol spray containers or canisters. Such canisters are well-known and they comprise as shown in FIG. 1 a container 10 having a cavity 12 for storing the lachrymator solution 14 and a propellant (not shown) such as preferably nitrogen ($N_2$) gas for pressurizing the cavity.

In order to be properly utilized in a pressurized canister the carrier must be a liquid or a gas at room or ambient temperature (i.e., 70° F.) and one atmosphere of pressure (i.e., ambient pressure) and preferably it has a boiling point of less than about 225° F. in order to help ensure sufficient dispersion or distribution of the capsicum once the solution is dispensed from the pressurized canister. Additionally, the carrier must not solidify or freeze at temperatures as low as −10° F. and preferably as low as −20° F. Further, the carrier must be such that the components of the lachrymator solution do not separate or come out of solution over extended periods of time such as three days, preferably three weeks, and more preferably four weeks.

Applicants have found that a nonflammable carrier suitable for use in the present invention is a mixture of propylene glycol, ethyl alcohol and water. Accordingly, the invention provides a solution for use as a lachrymator comprising capsicum and a nonflammable carrier. The solution comprises from about 0.1 to about 0.8 percent by weight capsicum, from about 7 to about 23 percent by weight propylene glycol, from about 31 to about 39 percent by weight ethyl alcohol and from about 46 to about 54 percent by weight water. Preferably, the invention-comprises from about 0.2 to about 0.4 percent by weight capsicum, from about 10 to about 18 percent by weight propylene glycol, from about 33 to about 37 percent by weight ethyl alcohol and from about 46 to about 54 percent by weight water. More preferably, the solution comprises about 0.3 percent by weight capsicum, about 14.7 percent by weight propylene glycol, about 35 percent by weight ethyl alcohol and about 50 percent by weight water.

An example of a capsicum and propylene glycol mixture suitable for use in the present invention is an oleoresin capsicum sold under the trade designation WS 500 by Kalsec, Inc. of Kalamazoo, Mich. 49005. This particular propylene glycol based oleoresin capsicum contains about 3.25 percent by weight capsicum rendering a mixture having a Scoville Unit (S.U.) of around 500,000. The Scoville Unit is derived utilizing a standard Scoville Heat Test as specified in Method 21.0 established by the American Spice Trade Association (ASTA).

An example of a suitable source of ethyl alcohol for use with the present invention is a denatured ethyl alcohol sold under the trade designation SDA-40-B by Midwest Grain Products, Inc. of Weston, Mo. 64098. SDA-40-B denatured ethyl alcohol contains about 99.9 percent by weight ethyl alcohol and about 0.1 percent by weight tertiary butyl alcohol and BITREX (denatonium benzoate).

An example of a suitable source of propylene glycol is a food grade propylene glycol USP available under the product code 70531 from the Dow Chemical Company of Midland, Mich. 48674.

The following examples will serve to illustrate the novel features and advantages of the present invention. While these examples will show one skilled in the art how to operate within the scope of this invention, they are not to serve as a limitation on the scope of the invention for such scope is only defined in the claims below.

In each of the examples, the stated components were mixed together in a glass beaker using a magnetic stir for a minimum of fifteen minutes prior to evaluation. Additionally, in the examples below the propylene glycol utilized is the Dow 70531 propylene glycol USP material, the oleoresin capsicum utilized is the Kalsec WS 500 and the ethyl alcohol utilized is Midwest's SDA-40-B. Further, all percentages set forth in the examples below are percents by weight.

EXAMPLE I

| | |
|---|---|
| Components - | 50 grams propylene glycol (50%)<br>6 grams oleoresin capsicum (6%)<br>44 grams $H_2O$ (44%) |

Remarks—After four days and freezing to −10° F. the mixture still did not separate. However, the viscosity of this material was such that the ability to provide adequate dispersion was questioned.

EXAMPLE II

| | |
|---|---|
| Components - | 33 grams propylene glycol (33%)<br>11 grams oleoresin capsicum (11%)<br>56 grams $H_2O$ (56%) |

Remarks—After four days and freezing to −10° F. the mixture still did not separate. However, once again the viscosity of the material was such that the ability to provide adequate dispersion was questioned.

EXAMPLE III

| | |
|---|---|
| Components - | 25 grams propylene glycol (25%)<br>11 grams oleoresin capsicum (11%)<br>64 grams $H_2O$ (64%) |

Remarks—After four days and freezing to −10° F. the mixture still did not separate. However, once again the ability to provide adequate dispersion was questioned.

EXAMPLE IV

| | |
|---|---|
| Components - | 50 grams propylene glycol (50%)<br>6 grams oleoresin capsicum (6%)<br>44 grams $H_2O$ (44%) |

Remarks—After hours, oil is floating on the surface. The oil appeared incapable of remixing completely.

EXAMPLE V

| | |
|---|---|
| Components - | 33 grams propylene glycol (33%)<br>11 grams oleoresin capsicum (11%)<br>56 grams $H_2O$ (56%) |

Remarks—After hours, oil is floating on the surface. The oil appeared incapable of remixing completely.

EXAMPLE VI

| | |
|---|---|
| Components - | 25 grams propylene glycol (25%)<br>11 grams oleoresin capsicum (11%)<br>64 grams $H_2O$ (64%) |

Remarks—After hours, oil is floating on the surface. The oil appeared incapable of remixing completely.

EXAMPLE VII

| | |
|---|---|
| Components - | 24 grams propylene glycol (24%)<br>6 grams oleoresin capsicum (6%)<br>35 grams ethyl alcohol (35%)<br>35 grams $H_2O$ (35%) |

Remarks—Some separation of oil occurs on the surface after mixing.

EXAMPLE VIII

| | |
|---|---|
| Components - | 20 grams propylene glycol (20%)<br>6 grams oleoresin capsicum (6%)<br>30 grams ethyl alcohol (30%)<br>44 grams $H_2O$ (44%) |

Remarks—Some separation of oil occurs on the surface after mixing.

EXAMPLE IX

| | |
|---|---|
| Components - | 44 grams propylene glycol (44%)<br>6 grams oleoresin capsicum (6%)<br>50 grams $H_2O$ (50%) |

Remarks—Some separation of oil occurs on the surface after mixing.

EXAMPLE X

| | |
|---|---|
| Components - | 20 grams propylene glycol (20%)<br>10 grams oleoresin capsicum (10%)<br>20 grams ethyl alcohol (20%)<br>50 grams $H_2O$ (50%) |

Remarks—Settling occurs after three days. Shaking the batch remixes, but it remains cloudy.

EXAMPLE XI

| | |
|---|---|
| Components - | 10 grams propylene glycol (10%)<br>10 grams oleoresin capsicum (10%)<br>30 grams ethyl alcohol (30%)<br>50 grams $H_2O$ (50%) |

Remarks—Settling occurs after three days. Shaking the batch remixes, but it remains cloudy.

EXAMPLE XII

| | |
|---|---|
| Components - | 10 grams propylene glycol (10%)<br>10 grams oleoresin capsicum (10%)<br>40 grams ethyl alcohol (40%)<br>40 grams $H_2O$ (40%) |

Remarks—The mixture stays clear. However, it is believed that the flammability may be too high for some applications.

EXAMPLE XIII

| | |
|---|---|
| Components - | 10 grams propylene glycol (10%)<br>10 grams oleoresin capsicum (10%)<br>35 grams ethyl alcohol (35%)<br>45 grams $H_2O$ (45%) |

Remarks—Settling occurs after three days. Shaking the batch remixes, but it remains cloudy.

EXAMPLE XIV

| | |
|---|---|
| Components - | 35 grams ethyl alcohol (35%)<br>10 grams oleoresin capsicum (10%)<br>55 grams $H_2O$ (55%) |

Remarks—Settling occurs after three days. Shaking the batch remixes, but remains cloudy.

EXAMPLE XV

| | |
|---|---|
| Components - | 10 grams oleoresin capsicum (10%)<br>5 grams propylene glycol (5%)<br>35 grams ethyl alcohol (35%)<br>50 grams $H_2O$ (50%) |

Remarks—No settling occurs in this formula after extended periods such as 40 days. The solution did not freeze when exposed to temperatures as low as −20° F. The solution is nonflammable and a liquid at ambient temperature and pressure with a boiling point of less than about 225° F. Dispersion of the solution through standard aerosol spray canisters displays very good knockdown effect and power.

While producing production quantities of the formulation set forth in Example XV preferably the formulation will be mixed in the proportions shown for a period of about one hour in 55 gallon drums utilizing mixers with collapsible mixing heads sold under the designation LIGHTING NC4 by the Mixing Equipment Company of Rochester, N.Y. Thorough mixing is required in order to eliminate any separation of the components of the solution which would require additional mixing of the solution at a later time. Upon completion of the mixing step the solution should appear clear and homogenous when viewed with a flashlight.

It will be appreciated that although in the above example propylene glycol has been employed, the invention contemplates the use of other glycols such as, for example, polyethylene glycol.

Although the invention has been shown and described with respect to certain preferred embodiments, it is obvious that equivalent alterations and modifications will occur to others skilled in the art upon the reading and understanding of the specification. The present invention includes all such equivalent alternations and modifications, and is limited only by the scope of the following claims.

What is claimed is:

1. A method of crowd control and personal defense, comprising spraying towards a person a lachrymator comprising about 0.1 to about 0.8 weight percent of capsicum, about 46 to about 54 weight percent of water, about 31 to about 39 weight percent of ethyl alcohol and about 7 to about 23 weight percent of glycol.

2. A method as set forth in claim 1, wherein said glycol comprises propylene glycol.

3. A method as set forth in claim 1, comprising from about 0.2 weight percent to about 0.4 weight percent capsicum.

4. A method as set forth in claim 1, comprising about 0.3 weight percent capsicum.

5. A method as set forth in claim 1, comprising about 14.7 weight percent glycol.

6. A method as set forth in claim 1, comprising from about 33 weight percent to about 37 weight percent ethyl alcohol.

7. A method as set forth in claim comprising about 35 weight percent ethyl alcohol.

8. A method as set forth in claim 1, comprising about 50 weight percent water.

9. A method as set forth in claim 1, wherein the method comprises spraying the lachrymator into a crowd.

10. A method as set forth in claim 1, wherein the method comprises spraying the person in the face.

11. A method as set forth in claim 1, wherein said spraying results in the person suffering one or more of intense burning eye pain, blepharospasm, acute bronchitis and respiratory irritation.

12. A method of using a lachrymator in a pressurized aerosol container for a defensive purpose, comprising spraying at least one person with a lachrymator, wherein the lachrymator comprises capsicum and a nonflammable carrier suitable for use in a lachrymator, said carrier being liquid at ambient temperature and pressure and having a boiling point of less than about 225° F., said carrier consisting essentially of water, denatured ethyl alcohol and propylene glycol, said lachrymator comprising from about 0.1 weight percent to about 0.4 weight percent capsicum, from about 10 weight percent to about 18 weight percent propylene glycol, from about 31 weight percent to about 39 weight percent denatured ethyl alcohol and from about 46 weight percent to about 54 weight percent of water, wherein said pressurized aerosol container does not have a source of heat for vaporizing said lachrymator.

13. A method as set forth in claim 12, wherein the lachrymator is a strong irritant to the eyes, mouth and nose of the person.

14. A method as set forth in claim 12, wherein said spraying results in the person suffering one or more of intense burning eye pain, blepharospasm, acute bronchitis and respiratory irritation.

15. A method of using a lachrymator comprising capsicum and a nonflammable carrier for defense, comprising spraying the lachrymator, wherein said nonflammable carrier contains no chlorofluorocarbons and has a boiling point of less than about 225° F., and said lachrymator comprises from about 0.2 weight percent to about 0.4 weight percent capsicum, from about 10 weight percent to about 18 weight percent glycol, from about 33 weight percent to about 37 weight percent ethyl alcohol and from about 46 weight percent to about 54 weight percent water.

16. A method as set forth in claim 15, comprising about 0.3 weight percent capsicum.

17. A method as set forth in claim 15, wherein said lachrymator comprises about 14.7 weight percent glycol.

18. A method as set forth in claim 15, wherein said lachrymator comprises about 50 weight percent water.

19. A method as set forth in claim 15, wherein said spraying is towards at least one person, wherein said at least one person is one or more of one of an unruly or disruptive crowd of persons, or is under the influence of alcohol or other mind-altering drugs.

20. A method as set forth in claim 15, wherein said spraying results in the person suffering one or more of intense burning eye pain, blepharospasm, acute bronchitis and respiratory irritation.

* * * * *